US007232270B1

(12) United States Patent
Goldstein

(10) Patent No.: US 7,232,270 B1
(45) Date of Patent: Jun. 19, 2007

(54) DEVICE FOR HOLDING WRITING INSTRUMENTS

(76) Inventor: Cassidy L. Goldstein, 1177 High Ridge Rd., Stamford, CT (US) 06905

( * ) Notice: Subject to any disclaimer, the term of this patent is extended or adjusted under 35 U.S.C. 154(b) by 100 days.

(21) Appl. No.: 10/898,480

(22) Filed: Jul. 22, 2004

Related U.S. Application Data

(60) Provisional application No. 60/490,497, filed on Jul. 28, 2003.

(51) Int. Cl.
*B43K 21/00* (2006.01)

(52) U.S. Cl. ..... 401/93; 401/92; 473/36

(58) Field of Classification Search ..... 401/55, 401/65, 82, 86, 92–94, 99; 473/35–39
See application file for complete search history.

(56) References Cited

U.S. PATENT DOCUMENTS

| | | | | | |
|---|---|---|---|---|---|
| 8,967 | A | * | 5/1852 | Hoffman | 125/29 |
| 340,925 | A | * | 4/1886 | Sandell | 401/94 |
| 1,151,933 | A | | 8/1915 | Fleming | |
| 1,861,466 | A | | 6/1932 | Bafetti | |
| 2,205,907 | A | | 6/1940 | Oxley | 120/13 |
| 2,213,465 | A | | 9/1940 | Gay | 120/68 |
| 2,290,886 | A | | 7/1942 | Lenz | 128/267 |
| 2,436,291 | A | | 2/1948 | Daniel | 215/43 |
| 2,591,831 | A | | 4/1952 | Knuff | 120/13 |
| 2,762,336 | A | | 9/1956 | Estes | 120/19 |
| 2,870,740 | A | | 1/1959 | Vogt | 120/1 |
| 3,086,674 | A | | 4/1963 | Sheuerman | 220/24 |
| 3,998,558 | A | * | 12/1976 | Katz | 401/94 |
| 4,415,092 | A | | 11/1983 | Boyer | 211/60 |
| 4,468,146 | A | | 8/1984 | Tabachnik | 401/88 |
| 4,600,112 | A | | 7/1986 | Shillington et al. | 215/274 |
| 4,856,693 | A | * | 8/1989 | Kageyama et al. | 226/127 |
| 4,948,009 | A | | 8/1990 | Sawatani | 220/229 |
| 5,025,947 | A | | 6/1991 | Leone | 220/90.2 |
| D360,223 | S | | 7/1995 | Lamber | D19/55 |
| D372,049 | S | | 7/1996 | Anderson | D19/55 |
| 5,551,787 | A | | 9/1996 | Rosenthal | 401/50 |
| 6,173,851 | B1 | | 1/2001 | Hague et al. | 215/201 |
| 6,402,407 | B1 | | 6/2002 | Goldstein | 401/6 |
| 6,793,429 | B2 | * | 9/2004 | Arrison | 401/93 |

* cited by examiner

*Primary Examiner*—Huyen Le
(74) *Attorney, Agent, or Firm*—Michael S. Neustel

(57) ABSTRACT

A device for holding writing instruments for efficiently holding a writing instrument. The device for holding writing instruments includes an outer sleeve, an inner sleeve movably positioned within an inner lumen of the outer sleeve, a plurality of fingers extending from an end of the inner sleeve, and a button attached to an end of the inner sleeve for allowing an individual to extend the inner sleeve partially from the outer sleeve. The fingers of the inner sleeve grip a writing instrument when positioned within the inner lumen of the outer sleeve and release the writing instrument when extended from an open end of the outer sleeve.

12 Claims, 10 Drawing Sheets

DEVICE FOR HOLDING WRITING INSTRUMENTS

CROSS REFERENCE TO RELATED APPLICATIONS

I hereby claim benefit under Title 35, United States Code, Section 119(e) of U.S. provisional patent application Ser. No. 60/490,497 filed Jul. 28, 2003. The 60/490,497 application is currently pending. The 60/490,497 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to writing instrument holders and more specifically it relates to a device for holding writing instruments for efficiently holding a writing instrument.

2. Description of the Related Art

Commonly utilized writing instruments include but are not limited to pens, pencils, chalk, crayons and the like. Chalk and crayons are commonly utilized by children when writing, drawing and scribbling. Crayons typically have a length of approximately 3.5 inches and a diameter of approximately 0.25 to 0.35 inches. Conventional writing chalk has similar lengths and diameters as crayons.

One problem with chalk and crayons is that they can be difficult to grasp within a child's hand. A further problem with chalk and crayons is that they can be messy and result in the child's hands becoming discolored. Another problem with chalk and crayons is that they can be easily damaged or broken during usage or storage. A problem with conventional writing instruments is that they are relatively narrow making them difficult to grasp by individuals suffering from arthritis and other physical impairments. Hence, it is desirable for an invention that helps overcome the shortcomings of conventional writing instruments.

BRIEF SUMMARY OF THE INVENTION

In view of the foregoing disadvantages inherent in the known types of writing instruments now present in the prior art, the present invention provides a new device for holding writing instruments construction wherein the same can be utilized for efficiently holding a writing instrument.

The general purpose of the present invention, which will be described subsequently in greater detail, is to provide a new device for holding writing instruments that increases the usefulness of the writing instruments mentioned heretofore and many novel features that result in a new device for holding writing instruments which is not anticipated, rendered obvious, suggested, or even implied by any of the prior art writing devices, either alone or in any combination thereof.

To attain this, the present invention generally comprises an outer sleeve, an inner sleeve movably positioned within an inner lumen of the outer sleeve, a plurality of fingers extending from an end of the inner sleeve, and a button attached to an end of the inner sleeve for allowing an individual to extend the inner sleeve partially from the outer sleeve. The fingers of the inner sleeve grip a writing instrument when positioned within the inner lumen of the outer sleeve and release the writing instrument when extended from an open end of the outer sleeve.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a device for holding writing instruments that will overcome the shortcomings of the prior art devices.

A second object is to provide a device for holding writing instruments for efficiently holding various types of writing instruments such as but not limited to chalk and crayons.

Another object is to provide a device for holding writing instruments that allows for easy loading and replacement of the writing instrument.

An additional object is to provide a device for holding writing instruments that extends the useful life of the writing instrument.

A further object is to provide a device for holding writing instruments that reduces damage and breakage of a writing instrument during usage and storage of the writing instrument.

Another object is to provide a device for holding writing instruments that reduces direct contact with a user's hands and the writing instrument.

A further object is to provide a device for holding writing instruments that provides for efficient removal of the writing instrument from thereof.

Another object is to provide a device for holding writing instruments that does not utilize small components that can be easily swallowed by a young child.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
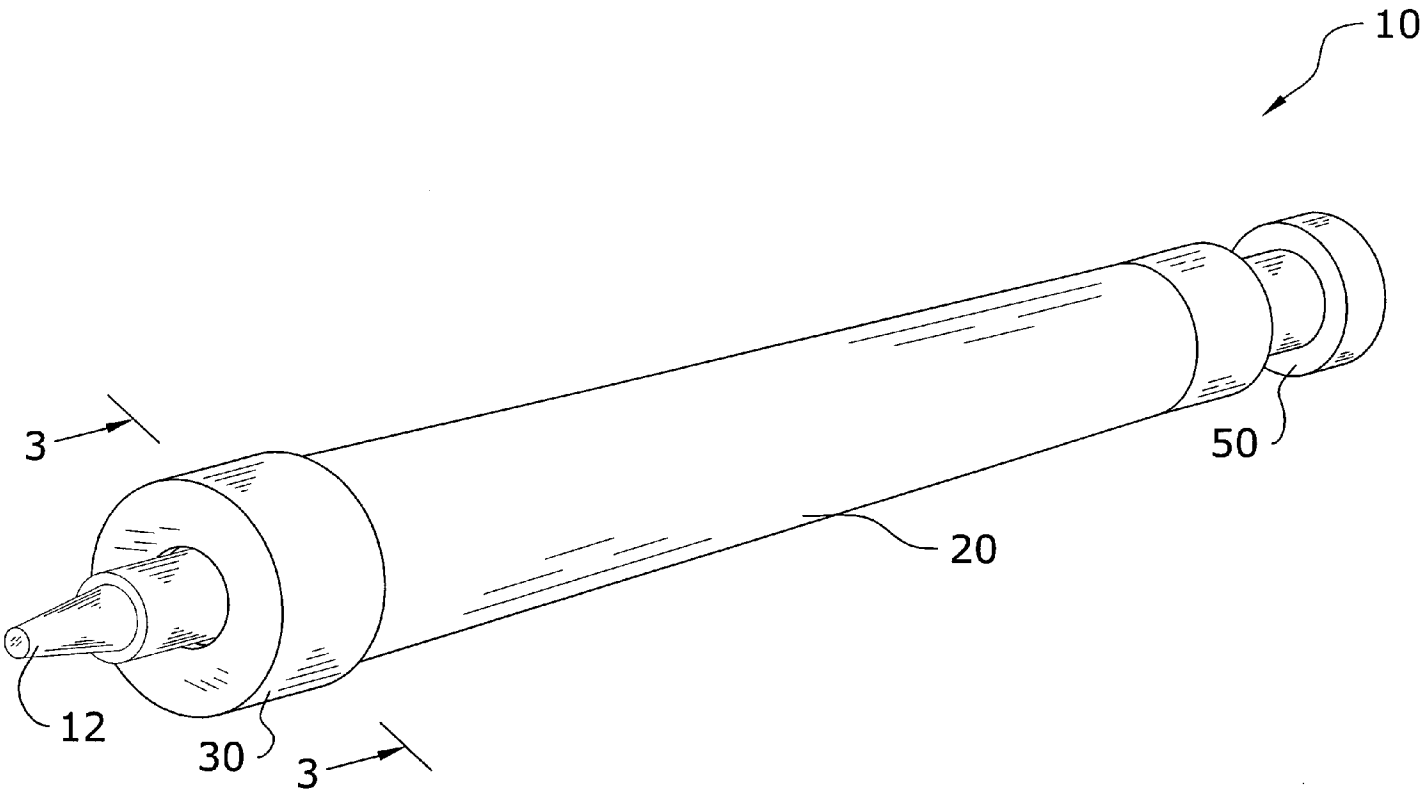
FIG. 1 is an upper perspective view of the present invention with a writing instrument retained within the same.
Figure 2:
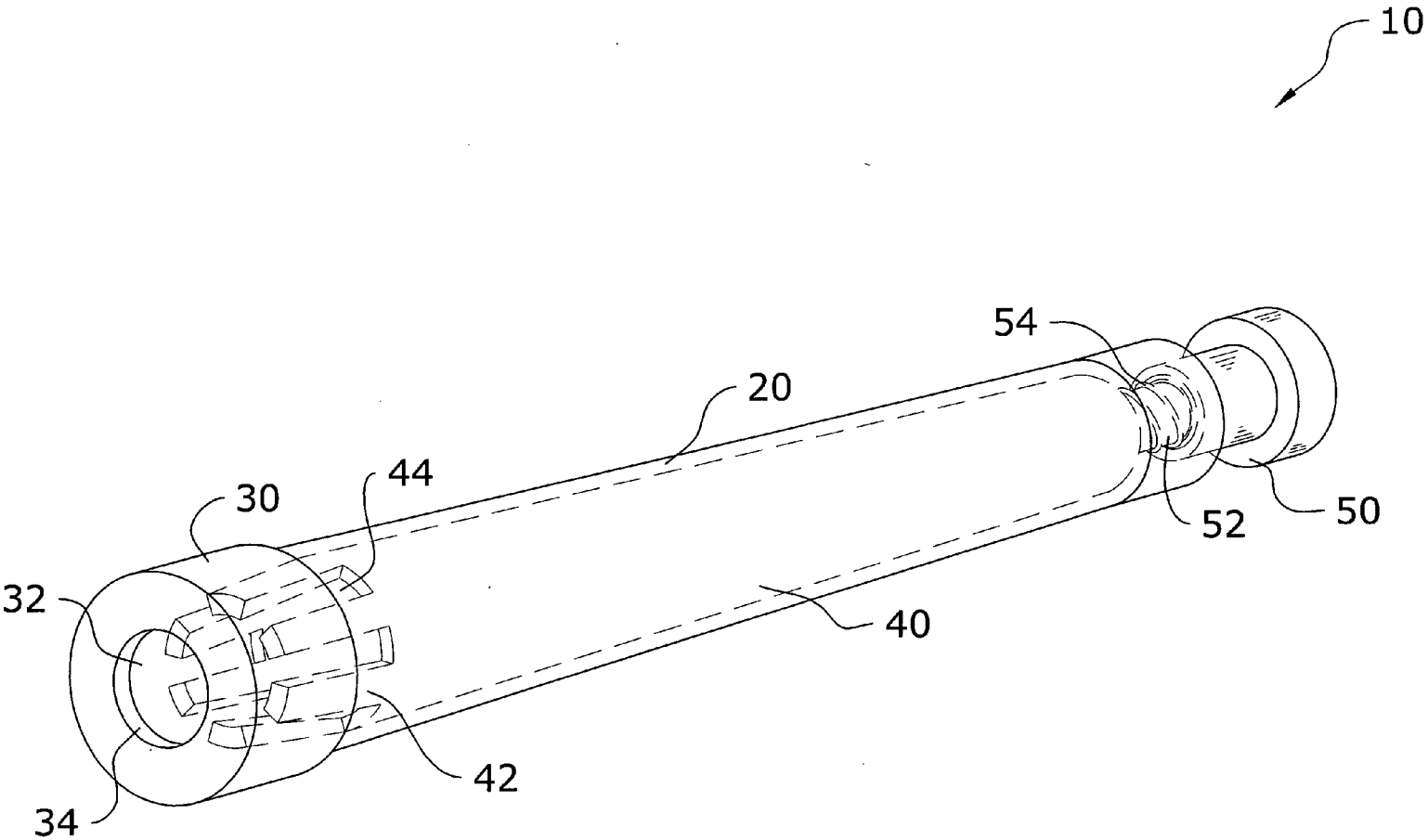
FIG. 2 is an upper perspective view of the present invention illustrating the inner sleeve within the outer sleeve.
Figure 3:
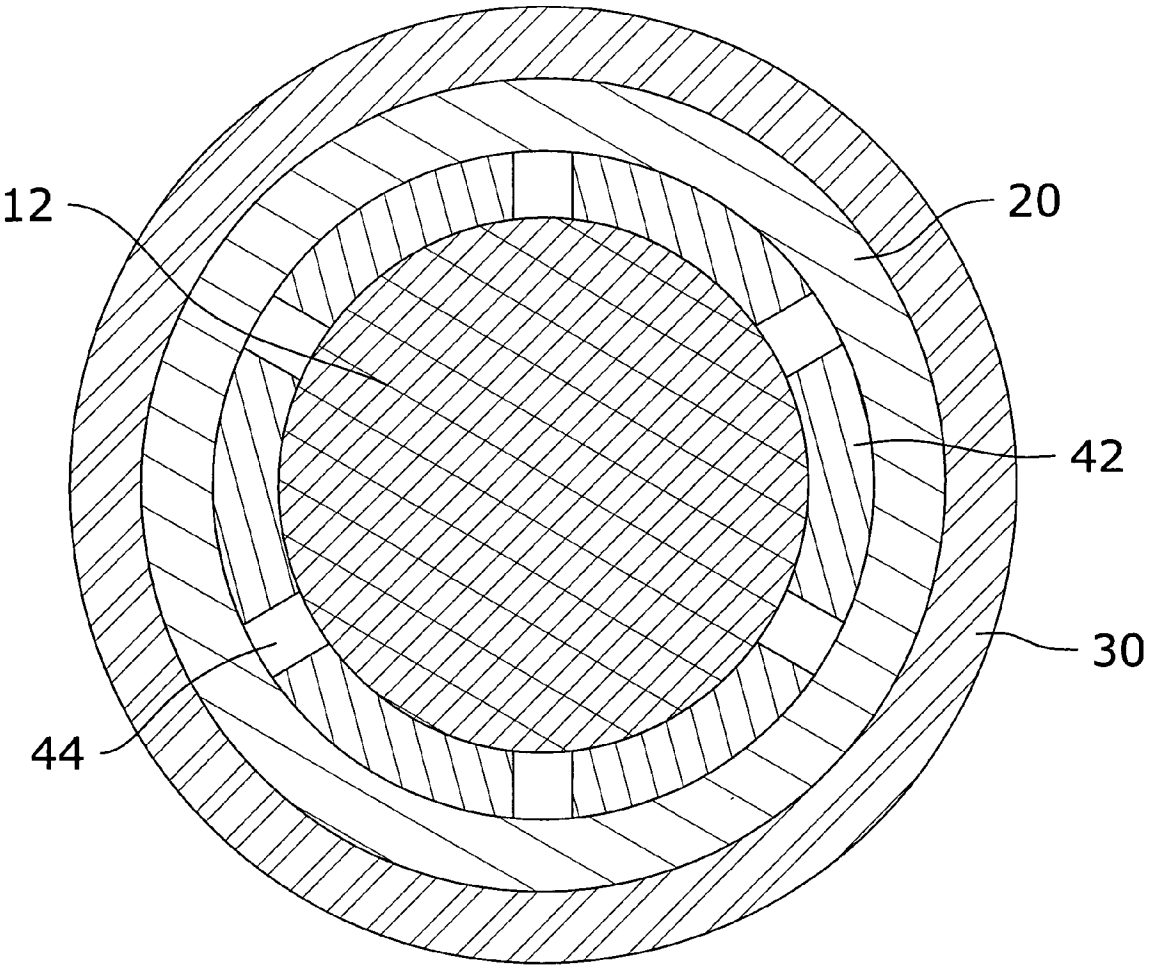
FIG. 3 is a cross sectional view taken along line 3—3 of FIG. 1.

Turning now descriptively to the drawings, in which similar reference characters denote similar elements throughout the several views, FIGS. 1 through 10 illustrate a device for holding writing instruments 10, which comprises an outer sleeve 20, an inner sleeve 40 movably positioned within an inner lumen 28 of the outer sleeve 20, a plurality of fingers 42 extending from an end of the inner sleeve 40, and a button 50 attached to an end of the inner sleeve 40 for allowing an individual to extend the inner sleeve 40 partially from the outer sleeve 20. The fingers 42 of the inner sleeve 40 grip a writing instrument 12 when positioned within the inner lumen 28 of the outer sleeve 20 and release the writing instrument 12 when extended from an open end of the outer sleeve 20.

B. Outer Sleeve

The outer sleeve 20 is comprised of an elongated structure as illustrated in FIGS. 1, 2, 4 and 5 of the drawings. The outer sleeve 20 includes an inner lumen 28 that receives the inner sleeve 40 as illustrated in FIGS. 6 through 9 of the drawings.

The outer sleeve 20 and the inner lumen 28 are preferably comprised of a tapered structure that tapers from the dispensing/receiving end as further illustrated in FIGS. 6 through 9 of the drawings. The taper of the inner lumen 28 is preferably similar to the taper of the external portion of the inner sleeve 40 as illustrated in FIGS. 6 through 9 of the drawings.

The outer sleeve 20 may be comprised of various materials such as but not limited to plastic, metal, composite, wood and the like. The outer sleeve 20 may also be transparent, semi-transparent or opaque. The outer sleeve 20 may be colored and labeled to include various indicia. The outer sleeve 20 may also receive various gripping materials such as but not limited to rubber for assisting the individual for gripping the exterior portion of the outer sleeve 20. The exterior surface of the outer sleeve 20 may also be ergonomically formed for receiving assisting a child or adult in gripping the outer sleeve 20 within their hand.

FIGS. 1, 2, 4 and 5 illustrate an end cap 30 extending from the dispensing/receiving end of the outer sleeve 20 forming an expansion cavity 32 for receiving the fingers 42 when extended from the outer sleeve 20. The end opening 34 extends through the end cap 30 as shown in FIGS. 2, 4, 6, 7, 8 and 9 of the drawings. The end opening 34 is formed for allowing free sliding of the writing instrument 12, such as but not limited to approximately 0.30 inches. It can be appreciated that greater or less diameters for the end opening 34 may be utilized.

C. Inner Sleeve

The inner sleeve 40 is slidably positioned within the outer sleeve 20 as illustrated in FIGS. 2 through 9. The inner sleeve 40 preferably has an elongated structure similar to the outer sleeve 20, wherein the external surface of the inner sleeve 40 is formed to slidably fit within the inner lumen 28 of the outer sleeve 20. The inner sleeve 40 includes a receiver lumen 46 for receiving a writing instrument 12 (e.g. chalk, crayon). As stated previously, the inner sleeve 40 is preferably tapered in a manner similar to the outer sleeve 20 as best illustrated in FIGS. 6 through 9 of the drawings.

The inner sleeve 40 may be comprised of various materials such as but not limited to plastic, metal, composite, wood and the like. The inner sleeve 40 may also be transparent, semi-transparent or opaque. The inner sleeve 40 may also be colored and labeled to include various indicia.

Figure 4:
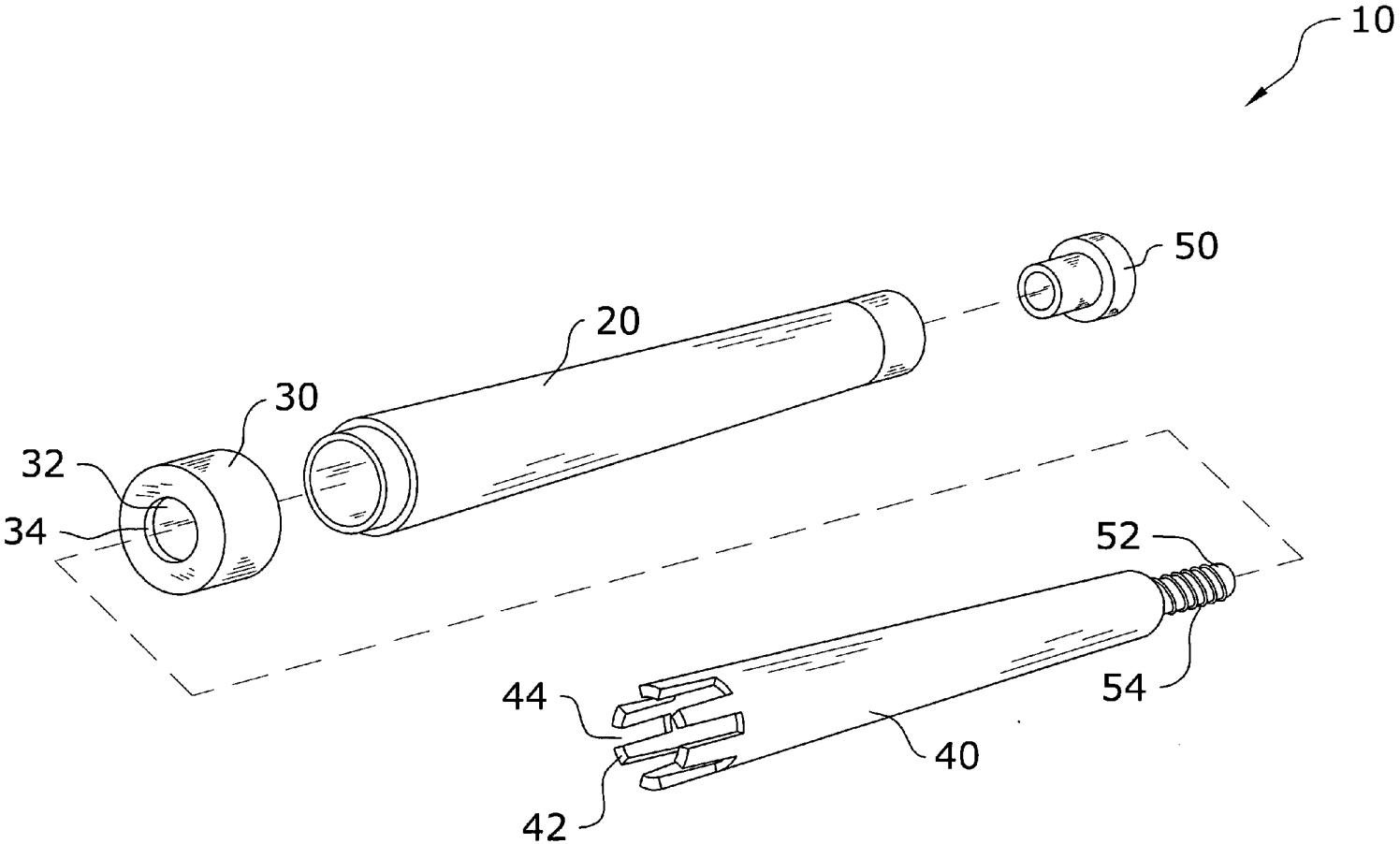
FIG. 4 is an exploded perspective view of the present invention.
Figure 5:
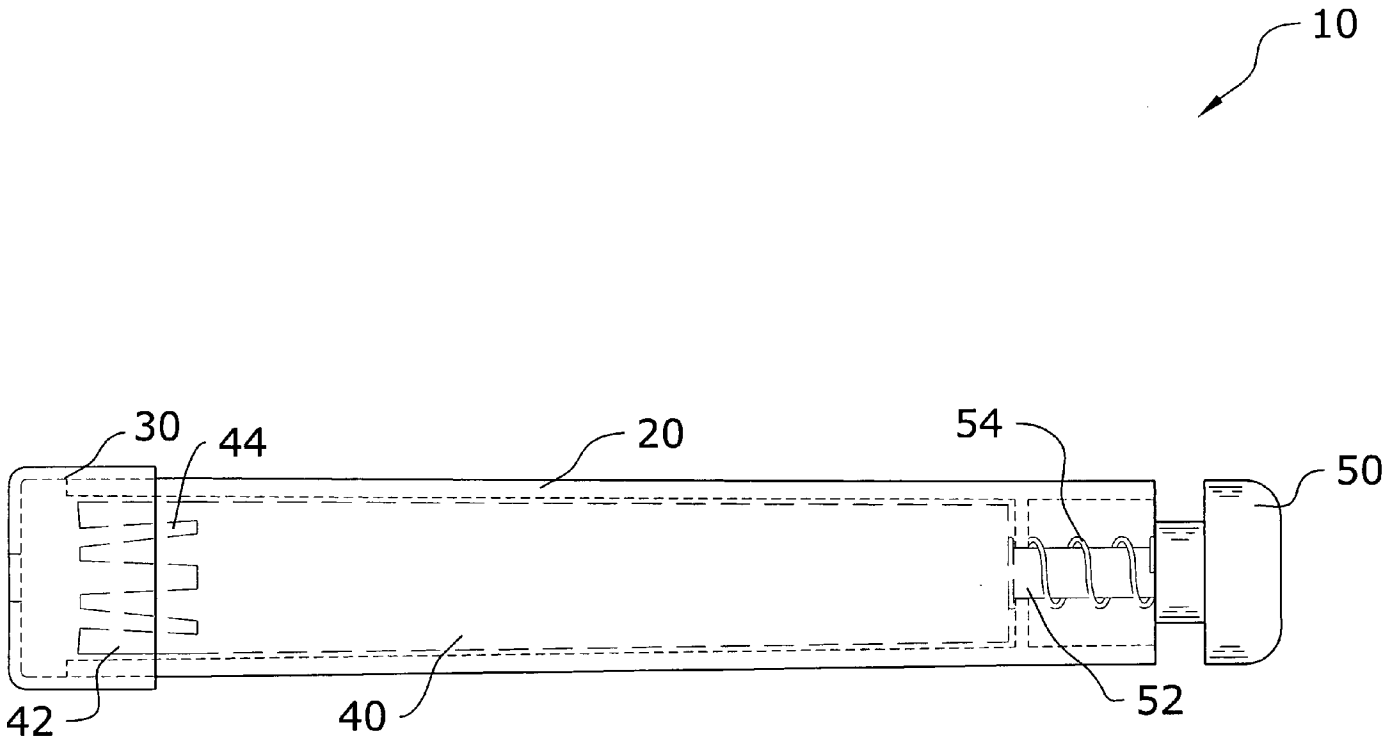
FIG. 5 is a side view of the present invention.
Figure 10:
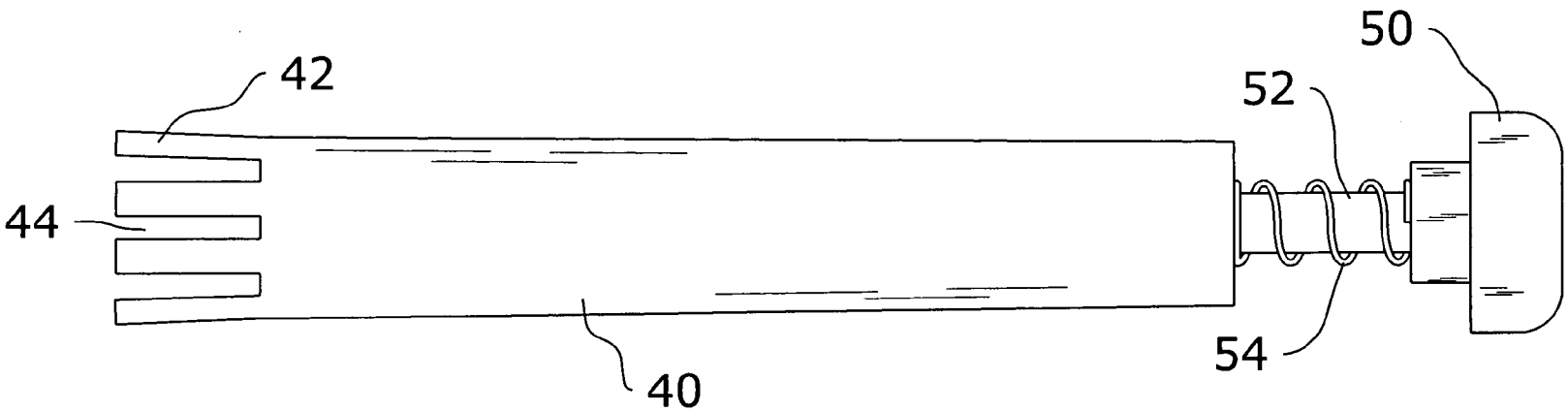
FIG. 10 is a side view of the present invention with the end cap removed.

The plurality of fingers 42 extend from a first end of the inner sleeve 40 as best illustrated in FIG. 4 of the drawings. The fingers 42 preferably extend outwardly at an angle from the inner sleeve 40 as best illustrated in FIG. 10 of the drawings.

Figure 6:
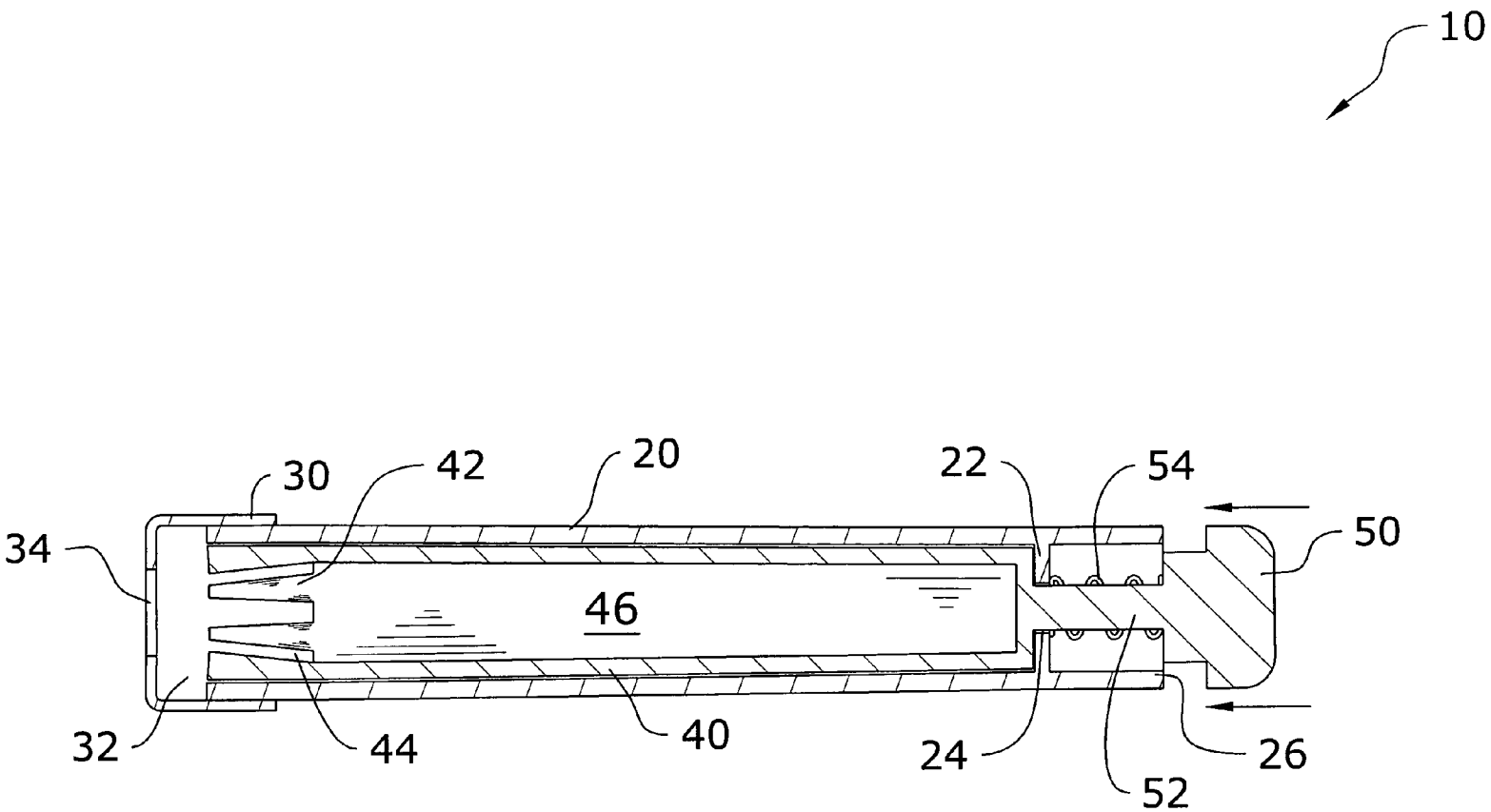
FIG. 6 is a side cutaway view of the present invention.
Figure 7:
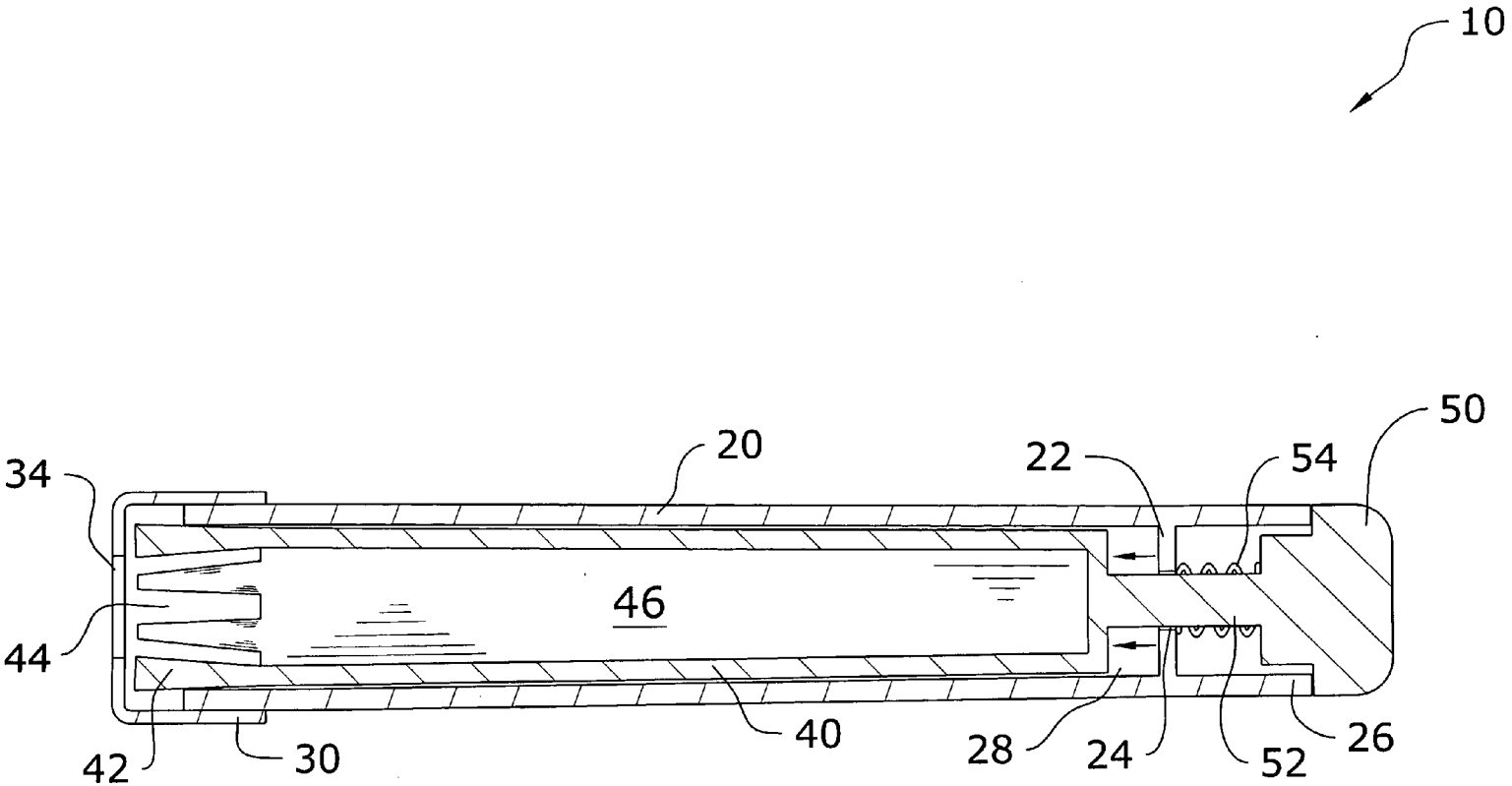
FIG. 7 is a side cutaway view of the present invention with the inner sleeve extended from the outer sleeve.
Figure 8:
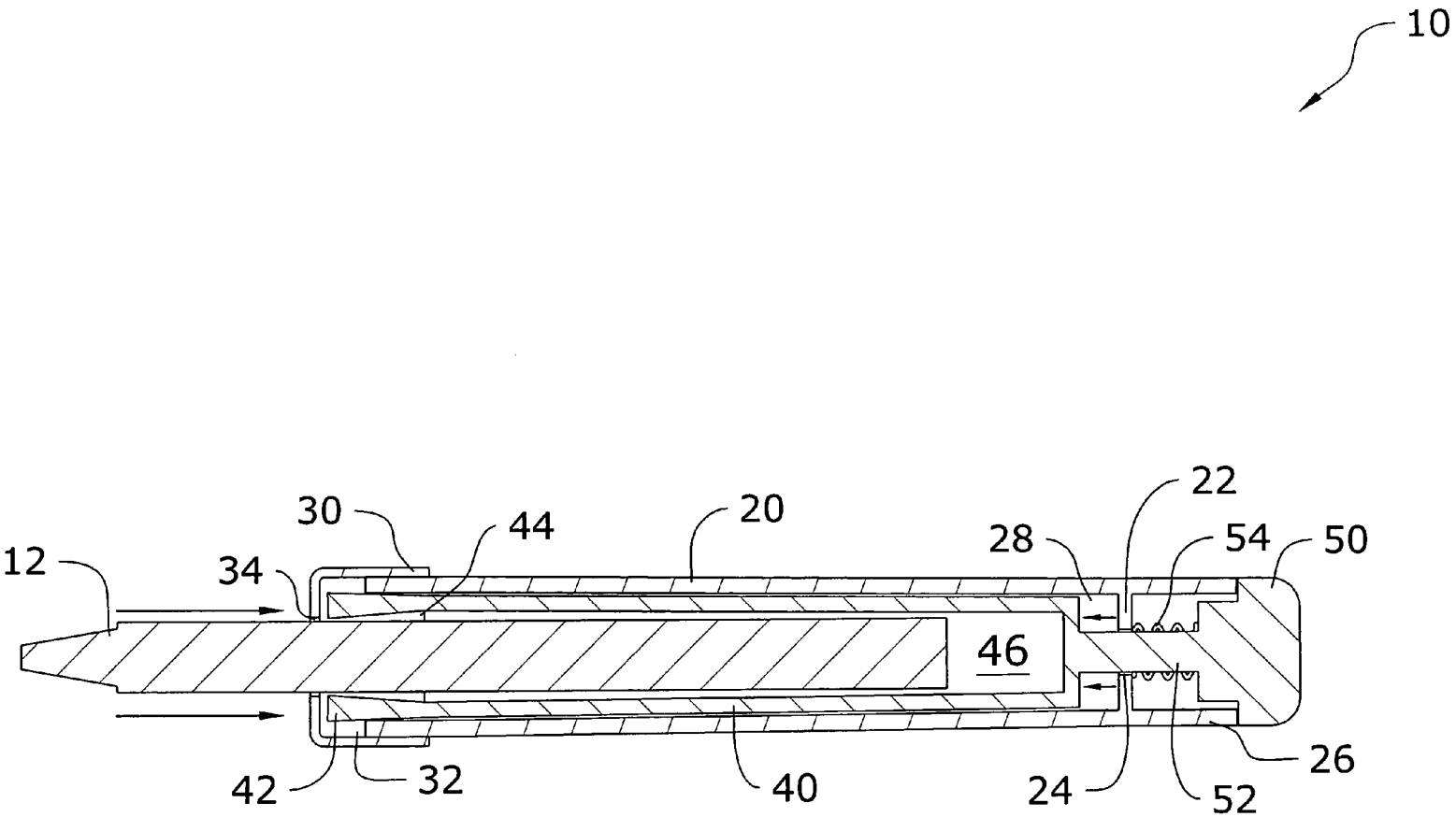
FIG. 8 is a side cutaway view of the present invention with a writing instrument being inserted into the inner sleeve.
Figure 9:
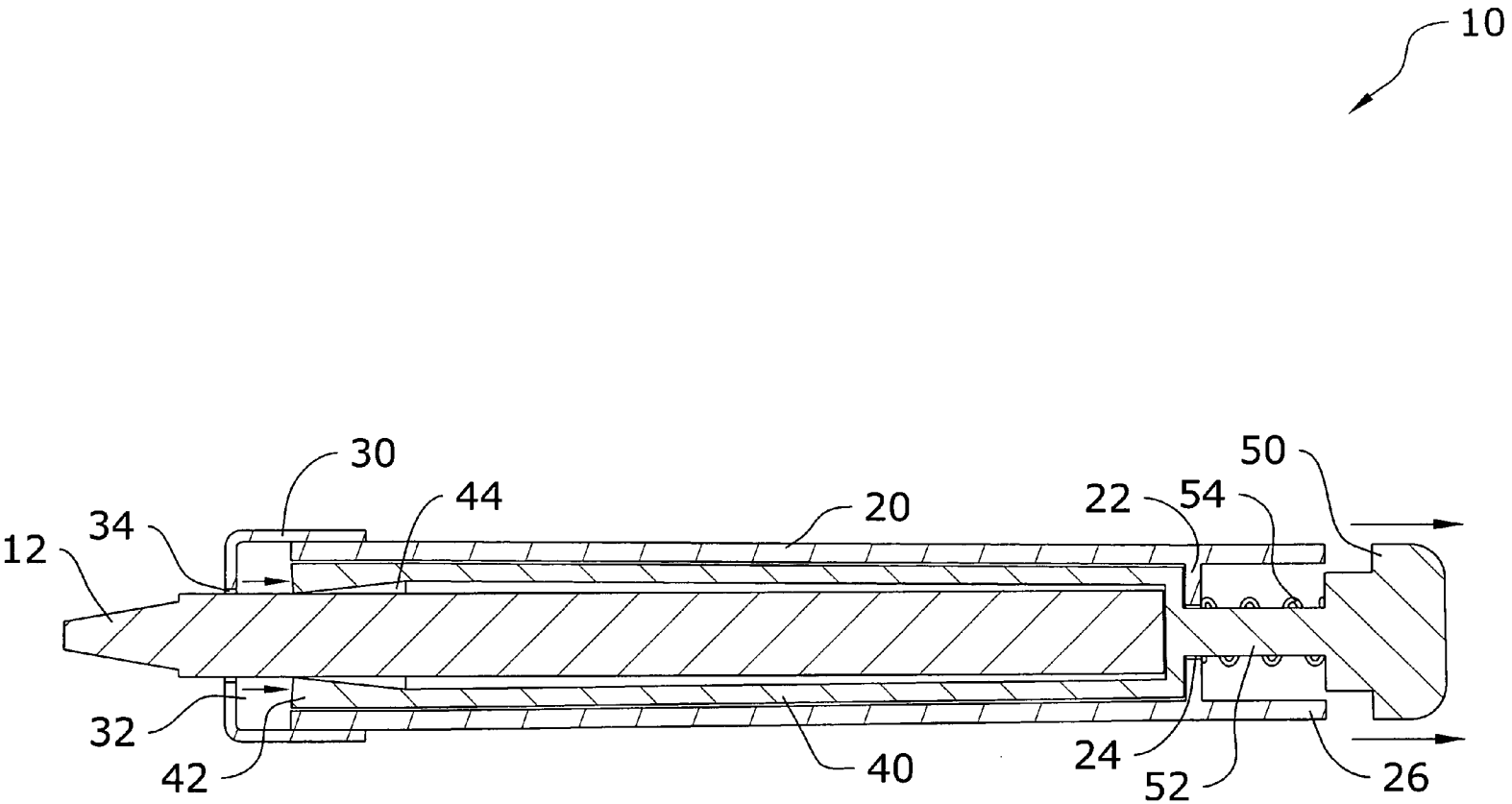
FIG. 9 is a side cutaway view of the present invention with the writing instrument gripped by the fingers of the inner sleeve.

A plurality of slots 44 preferably extend between the adjacent fingers 42 as shown in FIGS. 4, 6 through 9 of the drawings. A distal portion of the fingers 42 preferably has a thickness greater than an inner portion of the fingers 42 as illustrated in FIGS. 6 through 9 of the drawings. The fingers 42 contract and grip the writing instrument 12 when in contact with the outer sleeve 20 as shown in FIGS. 6 and 9 of the drawings. The fingers 42 expand and release the writing instrument 12 when extended outwardly from the outer sleeve 20 as shown in FIGS. 7 and 8 of the drawings.

D. Actuator Structure

Various structures may be utilized to extend and retract the inner sleeve 40 with respect to the outer sleeve 20. FIGS. 1 through 9 illustrate a preferred actuator structure that is comprised of button 50 connected to a second end of the inner sleeve 40 opposite of the fingers 42. The outer sleeve 20 includes a rear portion 26 for slidably receiving a portion of the button 50 as shown in FIGS. 6 through 9 of the drawings. In addition, a bias member 54 is connected between outer sleeve 20 and the button 50 for applying an outward bias force to the button 50 thereby causing the inner sleeve 40 to be retracted within the outer sleeve 20 when the button 50 is released.

As shown in FIGS. 6 through 9 of the drawings, a shaft 52 is attached between the button 50 and the second end of the inner sleeve 40. An inner flange 22 preferably extends inwardly from the inner lumen 28 of the outer sleeve 20 as illustrated in FIGS. 6 through 9 of the drawings. An inner opening 24 preferably extends through the inner flange 22 that slidably receives the shaft 52 as further shown in FIGS. 6 through 9 of the drawings.

The inner flange 22 is preferably positioned between the second end of the inner sleeve 40 and the button 50. The bias member 54 is preferably comprised of a compression spring that surrounds the shaft 52, wherein the bias member 54 is positioned between the inner flange 22 and the button 50 as shown in FIGS. 6 through 9 of the drawings.

E. Usage and Operation of Invention

To insert a writing instrument 12 (e.g. chalk, crayon) into the present invention, the user first depresses the button 50 as illustrated in FIG. 7 of the drawings. The depression of the button 50 causes the inner sleeve 40 to extend from the outer sleeve 20 with the fingers 42 extending into the expansion chamber of the end cap 30 as further illustrated in FIG. 7 of the drawings. The user then inserts the writing instrument 12 into the end opening 34 and slides the writing instrument 12 into the inner sleeve 40 while maintaining the button 50 in a depressed state as shown in FIG. 8 of the drawings.

After the writing instrument 12 is properly positioned within the inner sleeve 40, the user then releases the button 50 wherein the bias member 54 causes the inner sleeve 40 to retract with respect to the outer sleeve 20. As the inner sleeve 40 retracts within the outer sleeve 20, the fingers 42 engage the inner surface of the outer sleeve 20 and thereby contract upon the outer surface of the writing instrument 12. The contraction of the fingers 42 upon the writing instrument 12 results in the writing instrument 12 being gripped by the fingers 42, particularly the distal end of the fingers 42.

After the writing instrument 12 is properly positioned within the present invention, the user grasps the outer sleeve 20 with their hand. The exposed end of the writing instrument 12 (FIGS. 1 and 9) is then used to write, draw and/or scribble upon a surface. If the exposed end of the writing instrument 12 becomes broken, damaged or dull, the user simply depresses the button 50 which causes the writing instrument 12 to extend from the outer sleeve 20 where after the user may remove the writing instrument 12 for repair, modification or replacement. In addition, the user may readjust the position of the writing instrument 12 within the present invention by depressing the button 50, manipulating the position of the writing instrument 12 and then releasing the button 50.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An apparatus for holding writing instruments, comprising:

an outer sleeve including an inner lumen;

an inner sleeve including a receiver lumen for receiving a writing instrument, wherein said inner sleeve is slidably positioned within said inner lumen;

a plurality of fingers extending from a first end of said inner sleeve, wherein a distal portion of said fingers has a thickness greater than an inner portion of said fingers, wherein said fingers contract and grip the writing instrument when in contact with said outer sleeve, and wherein said fingers expand and release the writing instrument when extended outwardly from said outer sleeve;

an end cap extending from an end of said outer sleeve forming an expansion cavity for receiving said fingers when extended from said outer sleeve and wherein an end opening extends through said end cap to slidably receive the writing instrument, wherein said end opening is at least approximately 0.30 inches;

a button connected to a second end of said inner sleeve;

a bias member connected between outer sleeve and said button for applying an outward bias force to said button;

a shaft attached between said button and said second end of said inner sleeve; and an inner flange with an inner opening that slidably receives said shaft and wherein said inner flange is positioned between said second end of said inner sleeve and said button.

2. The apparatus for holding writing instruments of claim 1, wherein said bias member is comprised of a compression spring.

3. The apparatus for holding writing instruments of claim 1, wherein said bias member is comprised of a compression spring surrounding said shaft, and wherein said bias member is positioned between said inner flange and said button.

4. The apparatus for holding writing instruments of claim 1, wherein said fingers include a plurality of slots that extend between said fingers.

5. The apparatus for holding writing instruments of claim 1, wherein said outer sleeve and inner sleeve are comprised of a corresponding tapering structure.

6. An apparatus for holding writing instruments, comprising:

an outer sleeve including an inner lumen;

an inner sleeve including a receiver lumen for receiving a writing instrument, wherein said inner sleeve is slidably positioned within said inner lumen;

a plurality of fingers extending from a first end of said inner sleeve, wherein said fingers extend outwardly at an angle, wherein said fingers contract and grip the writing instrument when in contact with said outer sleeve, and wherein said fingers expand and release the writing instrument when extended outwardly from said outer sleeve;

an end cap extending from an end of said outer sleeve forming an expansion cavity for receiving said fingers when extended from said outer sleeve and wherein an end opening extends through said end cap to slidably receive the writing instrument, wherein said end opening is at least approximately 0.30 inches;

a button connected to a second end of said inner sleeve;

a bias member connected between outer sleeve and said button for applying an outward bias force to said button;

a shaft attached between said button and said second end of said inner sleeve; and an inner flange with an inner opening that slidably receives said shaft and wherein said inner flange is positioned between said second end of said inner sleeve and said button.

7. The apparatus for holding writing instruments of claim 6, wherein said bias member is comprised of a compression spring.

8. The apparatus for holding writing instruments of claim 6, wherein said bias member is comprised of a compression spring surrounding said shaft, and wherein said bias member is positioned between said inner flange and said button.

9. The apparatus for holding writing instruments of claim 6, wherein said fingers include a plurality of slots that extend between said fingers.

10. The apparatus for holding writing instruments of claim 6, wherein said outer sleeve and inner sleeve are comprised of a corresponding tapering structure.

11. An apparatus for holding writing instruments, comprising:

an outer sleeve including an inner lumen;

an inner sleeve including a receiver lumen for receiving a writing instrument, wherein said inner sleeve is slidably positioned within said inner lumen;

a plurality of fingers extending from a first end of said inner sleeve, wherein a distal portion of said fingers has a thickness greater than an inner portion of said fingers, wherein said fingers contract and grip the writing instrument when in contact with said outer sleeve, and wherein said fingers expand and release the writing instrument when extended outwardly from said outer sleeve;

an end cap extending from an end of said outer sleeve forming an expansion cavity for receiving said fingers when extended from said outer sleeve and wherein an end opening extends through said end cap to slidably receive the writing instrument, wherein said end opening is at least approximately 0.30 inches;

a button connected to a second end of said inner sleeve;

a bias member connected between outer sleeve and said button for applying an outward bias force to said button;

wherein said bias member is comprised of a compression spring;

a shaft attached between said button and said second end of said inner sleeve; and an inner flange with an inner opening that slidably receives said shaft and wherein said inner flange is positioned between said second end of said inner sleeve and said button;

wherein said bias member is comprised of a compression spring surrounding said shaft, and wherein said bias member is positioned between said inner flange and said button;

wherein said fingers include a plurality of slots that extend between said fingers.

12. The apparatus for holding writing instruments of claim 11, wherein said outer sleeve and inner sleeve are comprised of a corresponding tapering structure.

* * * * *